US011533990B1

(12) United States Patent
Stack

(10) Patent No.: US 11,533,990 B1
(45) Date of Patent: Dec. 27, 2022

(54) PORTABLE TABLE WITH A UNIQUE METHOD OF COLLAPSING AND STORAGE

(71) Applicant: Ian Stack, Weyland, MA (US)

(72) Inventor: Ian Stack, Weyland, MA (US)

( * ) Notice: Subject to any disclaimer, the term of this patent is extended or adjusted under 35 U.S.C. 154(b) by 0 days.

(21) Appl. No.: 17/496,418

(22) Filed: Oct. 7, 2021

(51) Int. Cl.
*A47B 37/04* (2006.01)
*A45F 3/44* (2006.01)
*A47B 3/00* (2006.01)

(52) U.S. Cl.
CPC ..... *A47B 37/04* (2013.01); *A45F 3/44* (2013.01); *A47B 2003/004* (2013.01); *A47B 2220/0008* (2013.01)

(58) Field of Classification Search
CPC ..... A47B 37/04; A47B 2003/004; A47B 2220/0008; A45F 3/44
USPC ..... 108/50.12
See application file for complete search history.

(56) References Cited

U.S. PATENT DOCUMENTS 1,571,129 A * 1/1926 Luckhoff ..... A47C 9/105 108/128
2,604,932 A * 7/1952 Leggett ..... A47B 3/00 108/174
3,295,473 A * 1/1967 Wentworth ..... A47B 31/06 108/66
4,461,220 A * 7/1984 Wetzel ..... A47B 37/04 108/30
4,584,946 A * 4/1986 Tucker ..... A47B 37/04 108/128
5,197,394 A * 3/1993 Schmidt ..... A47B 13/16 108/150
5,425,315 A * 6/1995 Huggins ..... A47B 3/00 108/115
6,199,569 B1 * 3/2001 Gibson ..... E04H 12/2223 52/157
8,191,561 B2 * 6/2012 Brooks, III ..... E04H 12/2223 248/533
9,706,834 B1 7/2017 Taylor
2019/0335893 A1 * 11/2019 Erickson ..... A47B 37/04

FOREIGN PATENT DOCUMENTS

FR 2532531 A * 3/1984 ..... A47B 3/00
GB 2558617 A * 7/2018 ..... A47B 13/023

OTHER PUBLICATIONS

Collapsible Wine & Beer Table, FOOD52.com. Available online Aug. 30, 2020. 2 pages. (https://food52.com/shop/products/6271-to-go-wine-beer-table?sku=18784&gclid=Cj0KCQjwqp-LBhDQARIsAO0a6aJVoEkODf6XlhH8Ykox9L1tryGfsrlPm0rpR0yWOmK2US2vijNrN4kaAikvEALw_wcB).

* cited by examiner

*Primary Examiner* — Janet M Wilkens
*Assistant Examiner* — Timothy M Ayres
(74) *Attorney, Agent, or Firm* — Wilmer Cutler Pickering Hale and Dorr LLP

(57) ABSTRACT

A foldable table is disclosed. The table includes a shaft having a first end and a second end. An auger used for twisting the table into the ground is located at the shaft's first end. A fixed member that houses a handle is located at the shaft's second end. The shaft also includes a slidable member that causes the table to move between open and closed positions. In the open position, upper slats form a tabletop surface. In the closed position, upper slats are folded inwardly such that the table can be easily stowed away or transported. Support members support the weight of the tabletop surface and are coupled to the fixed member, the upper slats, and the slidable member.

14 Claims, 10 Drawing Sheets

PORTABLE TABLE WITH A UNIQUE METHOD OF COLLAPSING AND STORAGE

The present invention concerns embodiments of a foldable table that is adapted for insertion into the sand or other ground surface.

BACKGROUND

Generally, people must walk from their cars to get onto the beach. Oftentimes people carry multiple items to bring with them on the beach, such as: umbrellas, beach chairs, beach towels, beach toys, coolers, food, snacks, etc. Therefore, when going to the beach, it is desirable to bring items that can be transported easily from the car to the beach.

Typically, the only place to set down belongings at the beach is on the sand or beach towel. Items such as food, drinks, phones, keys, money, etc. may be tripped over, kicked, lost, or damaged when left on the ground. Sand tends to inadvertently get inside a person's food and drink and therefore spoil it. Therefore, when going to the beach, it is desirable to bring a table or other elevated surface to protect a person's belongings from the sand and so objects can be placed at a convenient height above the sand or ground.

Most conventional beach tables are bulky, not easily transportable, and not easily secured. There is a need for improved beach tables that are easily transportable.

SUMMARY

Embodiments of the present disclosure provide a foldable beach table. The foldable table may be collapsed into a closed position in which the table can be easily transported, e.g., from a car to a beach. The foldable table may also be secured into the sand, or ground, and opened into a position that provides a flat tabletop surface. Once deployed, the table may be used for conveniently supporting objects, e.g., drinks, food, keys, etc.

The foregoing and other features and advantages of the invention will become more apparent from the following detailed description, which proceeds with reference to the accompanying figures.

DETAILED DESCRIPTION OF THE PREFERRED EMBODIMENTS

Figure 1A:
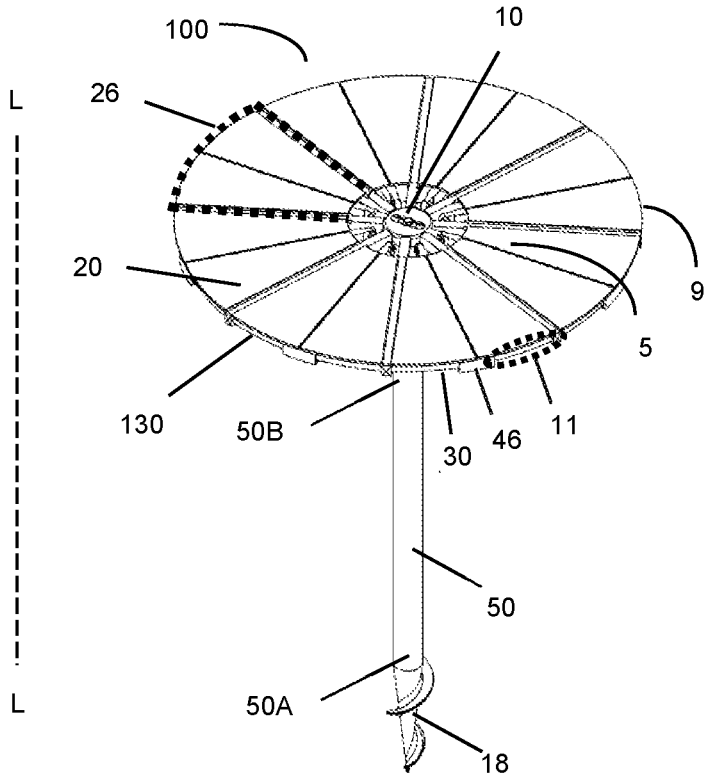
FIG. 1A is a perspective view of a foldable table constructed in accordance with the invention in the open position.
Figure 1B:
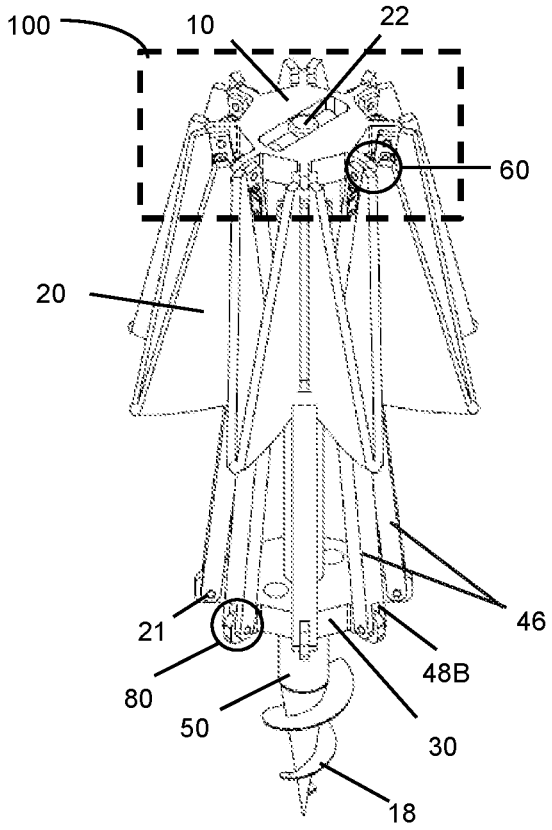
FIG. 1B is a perspective view of a foldable table, with an enlargement thereof, constructed in accordance with the invention in the closed position.
Figure 1B:
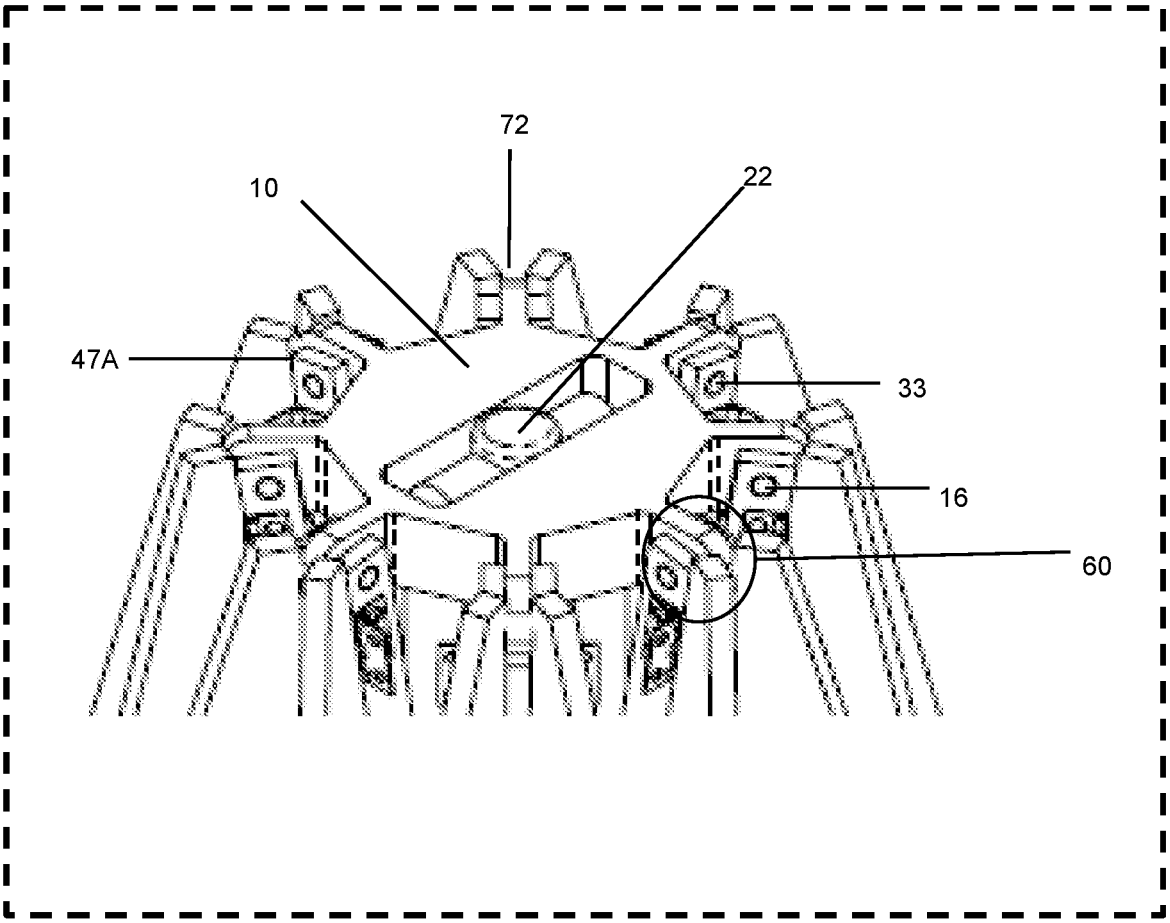
Figure 1D:
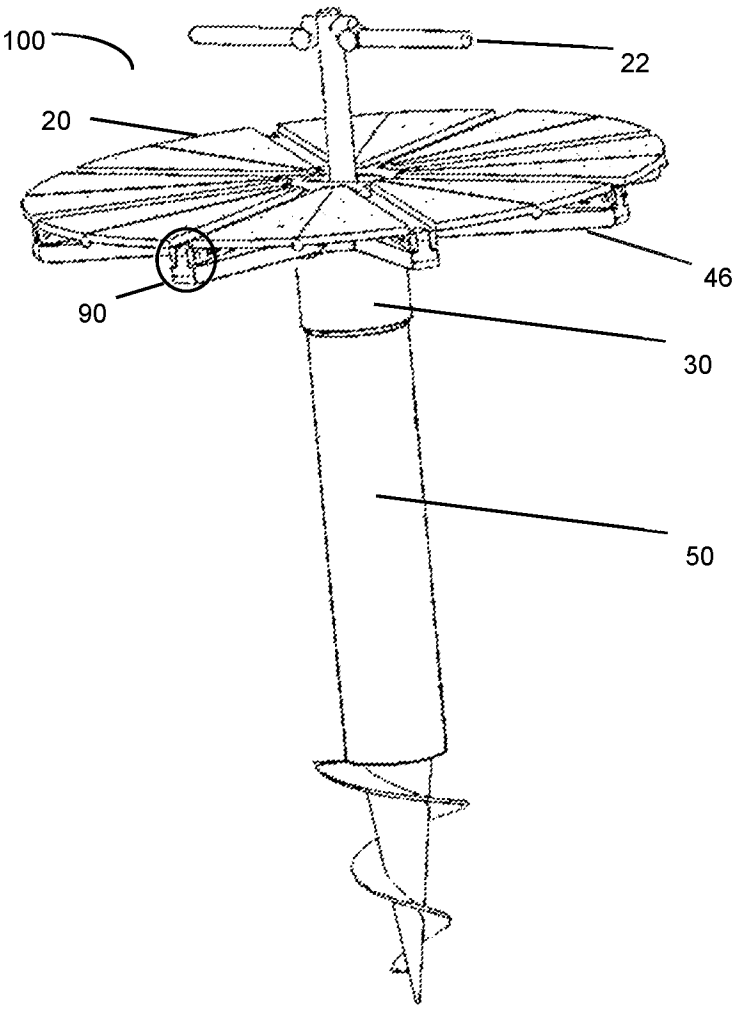
FIG. 1D is a side view of a foldable table constructed in accordance with the invention in the open position.
Figure 1C:
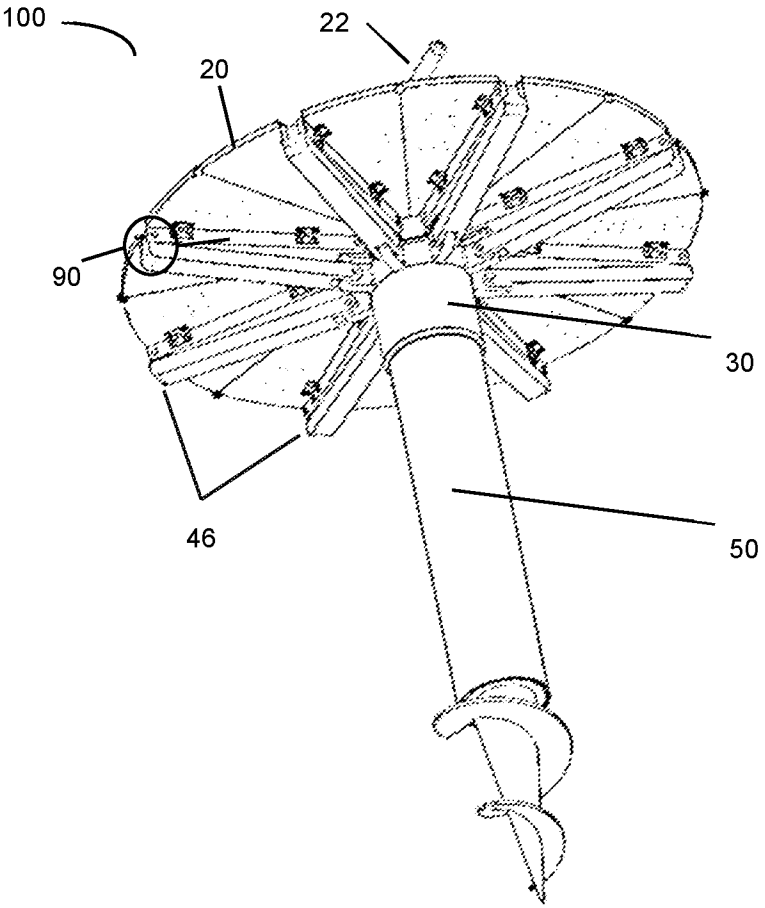
FIG. 1C is a bottom view of a foldable table constructed in accordance with the invention in the open position.

FIGS. 1A, 1B, and 1C show a first embodiment of a foldable table 100.

FIGS. 1A and 1C show foldable table 100 in the open position. FIG. 1B shows foldable table 100 in the closed position. Table 100 includes a plurality of upper slats 20, a plurality of support members 46, a shaft 50, a fixed member 10, and a slidable member 30. Slidable member 30 is coupled to the shaft 50 such that slidable member 30 can slide along an axis L-L as shown in FIG. 1A. Sliding slidable member 30 along shaft 50 causes the table 100 to transition between the open and closed positions.

A. Upper Slats

In the open position, the upper slats 20 form a flat tabletop surface 5. In the closed position, table 100 can be easily stowed away or transported. Preferably, the upper slats 20 are shaped such that when table 100 is in the open position, the tabletop surface 5 is circular as shown in FIG. 1A. However, the upper slats 20 can have other suitable shapes and lengths. For example, the upper slats could be shaped such that the tabletop surface is rectangular when table 100 is in the open position. In a preferred embodiment, table 100 includes eight upper slats 20. Although eight slats are preferred, any suitable number of slats may be used. One preferred choice of material for upper slats 20 is bamboo. Other suitable materials may also be used, including but not limited to: wood, aluminum, steel, polyester, nylon, and plastic.

Figure 7:
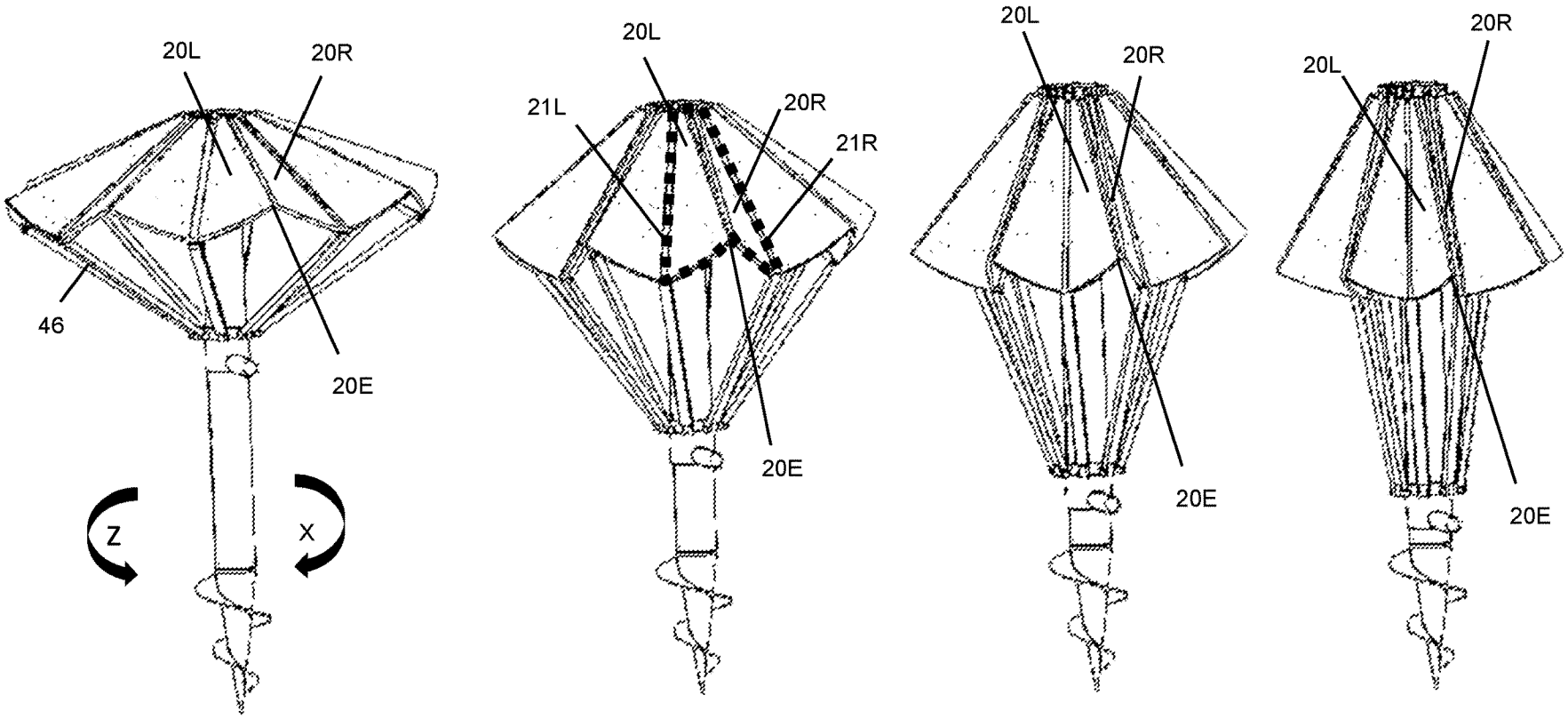
FIG. 7 shows perspective views of a foldable table transitioning between the open and closed positions.

As shown in FIG. 7, each upper slat 20 includes a left-half 20L, a right-half 20R, and a central edge 20E. In a single upper slat 20, the left-half 20L and the right-half 20R meet at, and can fold along, the central edge 20E. When transitioning from an open position to a closed position, each upper slat 20 folds along its central edge 20E such that left-half 20L folds in a counter-clockwise direction (as indicated generally by the arrow Z) and right-half 20R folds in a clockwise direction (as indicated generally by the arrow X). Conversely, when transitioning from a closed position to an open position, left-half 20L unfolds in a clockwise direction (generally in a direction opposite to arrow Z) and right-half 20R unfolds in a counter-clockwise direction (generally in a direction opposite to arrow X). As shown in FIG. 1A, when the table 100 is in the open position, each slat forms a flat sector 26 of the tabletop surface 5, with sector 26 being shown in dotted lines.

As seen in FIG. 7, each upper slat has a left boundary 21L (at the left-most portion of left-half 20L) and a right boundary 21R (at the right-most portion of right-half 20R). Each slat's left boundary 21L abuts an adjacent slat's right boundary 21R. Likewise, each slat's right boundary 21R abuts an adjacent slat's left boundary 21L.

In the preferred embodiment, left-half 20L and right-half 20R of each upper slat 20 are connected by a hinge or other connector such that slat 20 can fold along central edge 20E. If a hinge is used, any suitable hinge may be used. As yet another alternative, two rigid halves 20L and 20R may be bonded together using a flexible material like cloth. In this case, the flexible material allows the two halves 20L and 20R to bend along central edge 20E.

It is also envisioned that left-half 20L and right-half 20R are halves of one uniform upper slat 20. In such a case, the thickness of the slats 20 can vary such that the left boundary 21L and right boundary 21R are the thickest portions of the slat 20. Slat 20 becomes gradually thinner from each boundary 21L and 21R such that central edge 20E is the thinnest portion of slat 20, allowing slat 20 to bend at central edge 20E. It is also envisioned that instead of a gradual tapering in thickness, the left-half 20L and the right-half 20R of each upper slat 20 are made of a rigid material having a mostly uniform thickness while the central edge 20E remains the thinnest portion of slat 20. This allows the slat 20 to bend at the central edge 20E because central edge 20E is the thinnest part of slat 20.

Referring to FIG. 1A, in one embodiment, peripheral surface 9 of each upper slat 20 includes a rim segment 11. When the table is in the open position, as seen in FIG. 1A, the rim segments 11 collectively form an outer rim 130. The rim segments 11 (and outer rim 130) are preferably made of metal but any suitable material may be used. Outer rim 130 provides additional structural stability to the table 100, e.g., making it more resistant to items contacting or banging into table 100 when it is deployed.

B. Shaft, Auger, Slidable Member, Handle, Fixed Member

Referring to FIG. 1A, shaft 50 has a first shaft end 50A and a second shaft end 50B. Shaft 50 defines a longitudinal axis L-L. The shaft 50 is preferably made from bamboo, e.g., because bamboo is both strong and lightweight. Other suitable materials may also be used, including but not limited to: wood, aluminum, steel, polyester, nylon, and plastic.

The first shaft end 50A defines an auger 18. The auger 18 is desirably made of metal but may also be made of any other suitable material, such as plastic. The auger is configured to twist into the ground to stabilize table 100. Preferably, shaft 50 is rotated such that auger 50 digs into the sand. When deploying table 100 at a beach, once the auger 18 is sufficiently deep beneath the surface of the beach, the shaft 50 is sufficiently stable for deploying the table into the open position as shown, e.g., in FIG. 1A. While table 100 may be used at a beach, it is also contemplated that table 100 may be used on other locations as well, e.g., the auger may twist into grass, dirt, or other surface. If shaft 50 is driven vertically into the sand, flat tabletop surface 5 will be horizontal when the table 100 is in the open position.

Slidable member 30 is slidably coupled to the shaft 50 along the longitudinal axis L-L. Slidable member 30 defines a central aperture through which shaft 50 extends. Movement of slidable member 30 along the longitudinal axis L-L causes corresponding movement of the foldable table 100 between the open and closed position. For example, slidable member 30 is located near the shaft first end 50A when table 100 is in the closed position and near the shaft second end 50B when table 100 is in the open position. When the slidable member 30 is located near the midpoint of the shaft 50, the foldable table 100 is in between the closed and open positions. Preferably, slidable member 30 is implemented as a disk and is made of aluminum. However, any suitable material may be used. Preferably, the exterior surface of slidable member 30 is covered by a handle grip, allowing a user to comfortably grip slidable member 30 while moving member 30 along the longitudinal axis L-L of shaft 50. The handle grip may be made of any suitable material, such as firm or soft plastic, foam, or gel.

Figure 2:
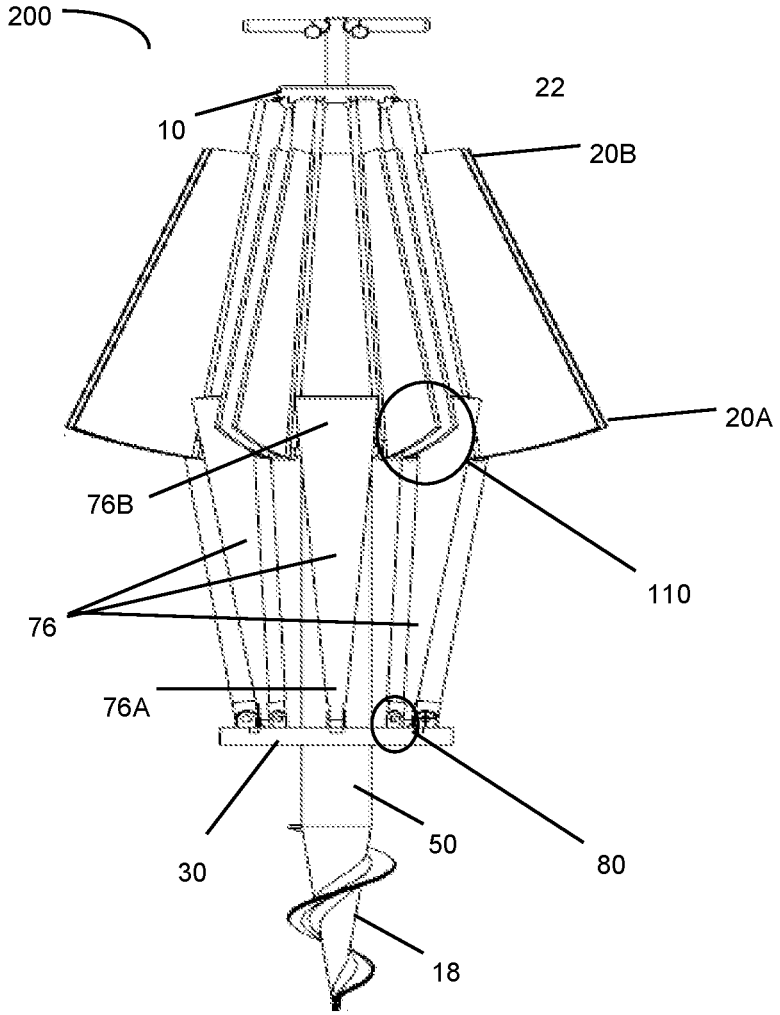
FIG. 2 is a perspective view of a foldable table constructed in accordance with the invention between the open and closed positions.
Figure 6:
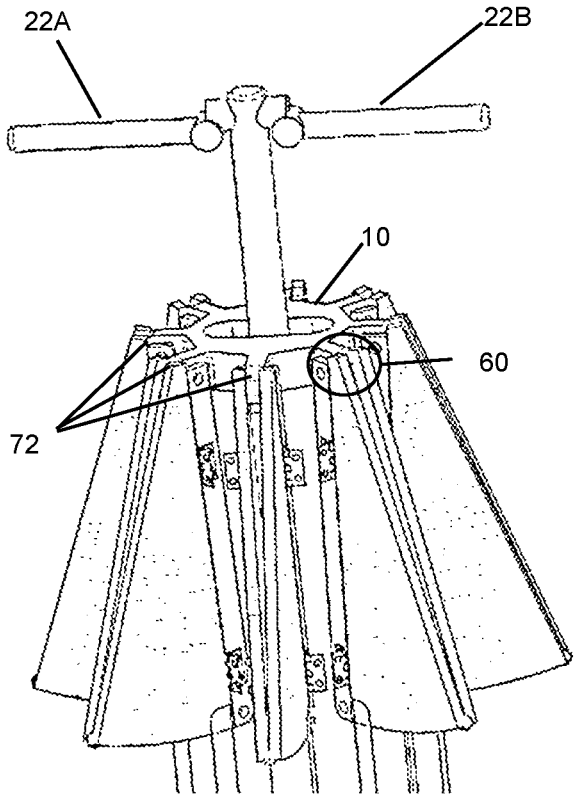
FIG. 6 is a perspective view of the top portion of a foldable table constructed in accordance with the invention.

Fixed member 10 is located proximal to the second shaft end 50B. Preferably, fixed member 10 is implemented as a flat plate. As shown in FIG. 2, fixed member 10 is shaped to receive a handle 22. The handle 22 is configured to move along the longitudinal axis L-L. That is, handle 22 can be extended and locked into place as shown in FIG. 2 and handle 22 can be retracted into the shaft 50 and slidable member 30 as shown in FIG. 2. When handle 22 is extended, e.g., as shown in FIG. 2, twisting handle 22 rotates shaft 50 and auger 18. Thus, a user can drive auger 18 into the sand, or ground, by rotating handle 22 about axis L-L. Although in the preferred embodiment, handle 22 moves independent from slidable member 30, it is envisioned that handle 22 may be operatively connected to slidable member 30 such that longitudinal movement of the handle is effective to cause corresponding movement of the slidable member 30 and therefore cause table 100 to move between the open and closed positions. As seen in FIG. 6, handle 22 is T-shaped but the handle 22 may be any suitable shape. Handle 22 may have hinge points on each arm 22A, and 22B, such that each handle arm may move independently from the other. Handle 22 is preferably made of aluminum but may be made of any suitable material.

C. Support Members

As shown in FIGS. 1A-D, 4-7, table 100 has a plurality of support members 46. Support members 46 are configured to support the weight of tabletop surface 5 and any items placed on tabletop surface 5. Support members 46 are desirably made of metal but any suitable material may be used.

i. Relationship with Slats

Figure 3:
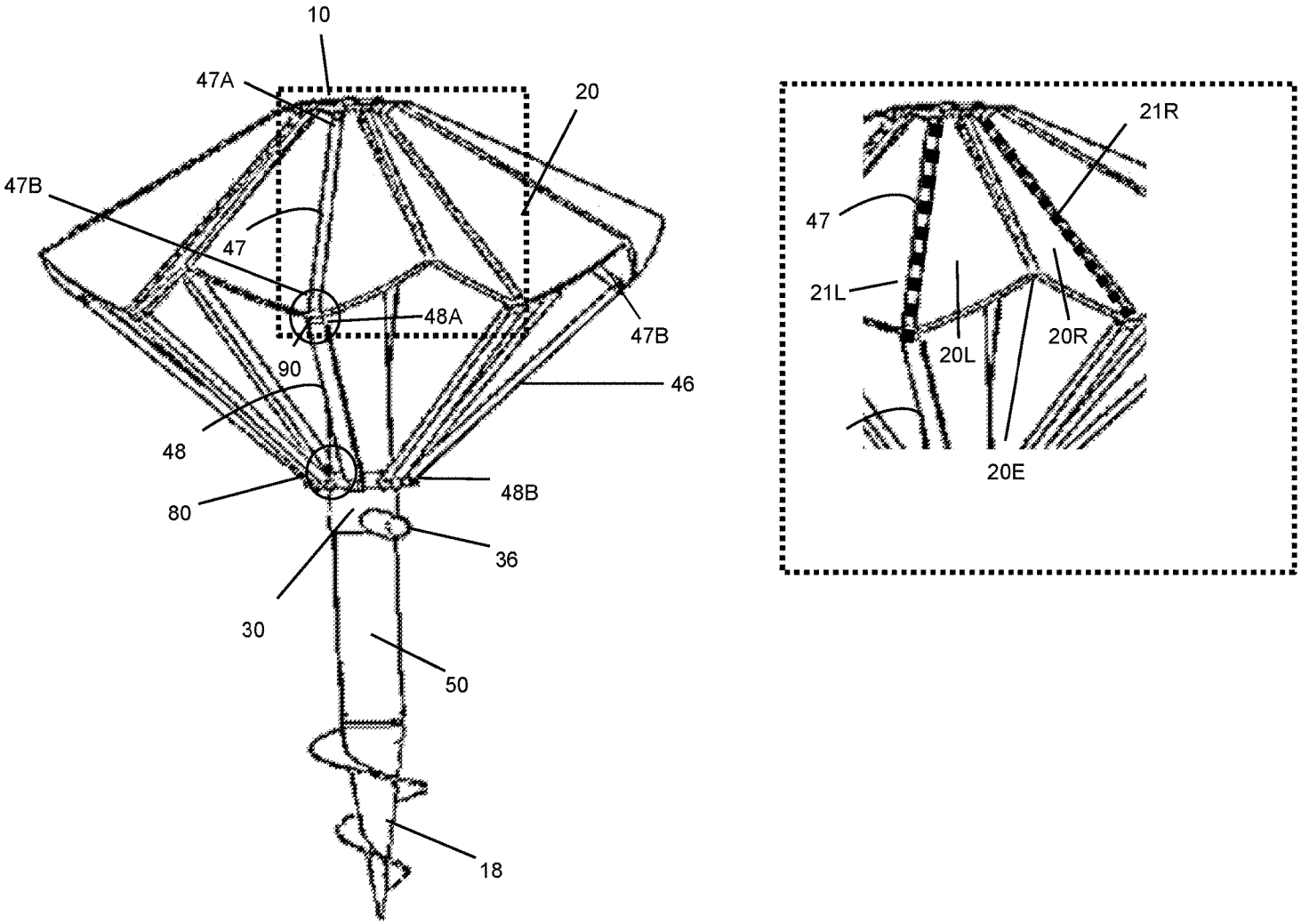
FIG. 3 is a perspective view of another foldable table, with an enlargement thereof, constructed in accordance with the invention between open and closed positions.
Figure 8:
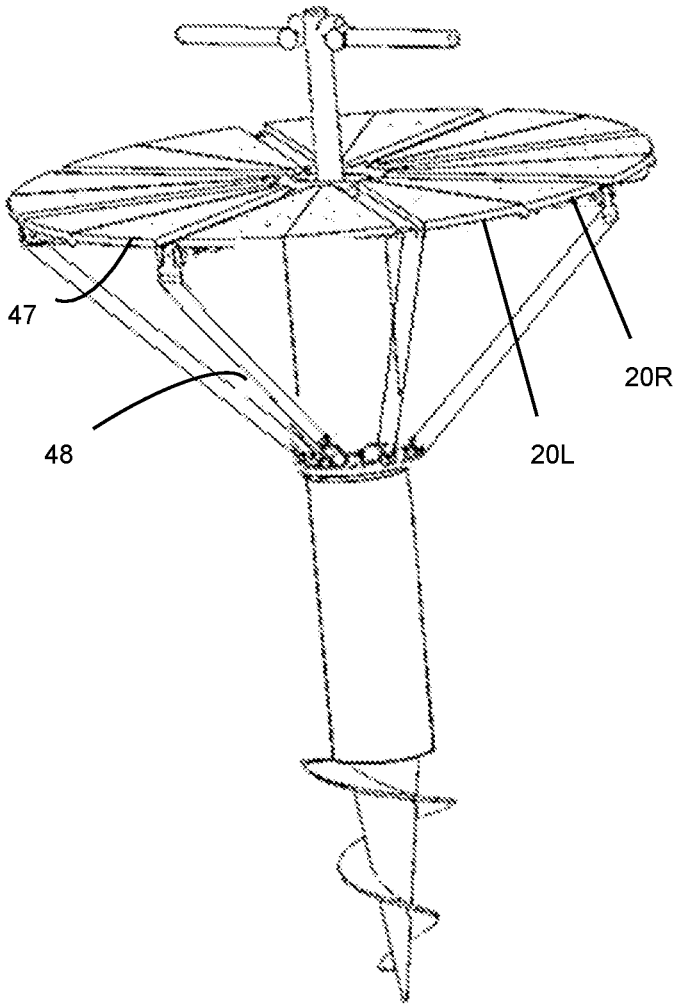
FIG. 8 is a perspective view of another foldable table constructed in accordance with the invention in the open position.

As shown in FIG. 3, support members 46 have an upper arm 47 and a lower arm 48. Each slat 20 is permanently bonded to an upper arm 47 at left boundary 21L and an additional upper arm 47 permanently bonded at right boundary 21R. As shown in FIG. 1C, in the first embodiment, the support members 46 are configured to lie flat against upper slats 20 when table 100 is in the open position such that the upper slats 20 are touching and parallel with the upper arms 47 and the upper arms 47 are touching and parallel with the lower arms 48. In an alternative embodiment shown in FIG. 8, upper slats 20 are touching and parallel with upper arms 47, while upper arms 47 and lower arms 48 form an angle of less than 90 degrees relative to each other when table 100 is in the open position.

ii. Attachment of Upper and Lower Arms

Figure 4:
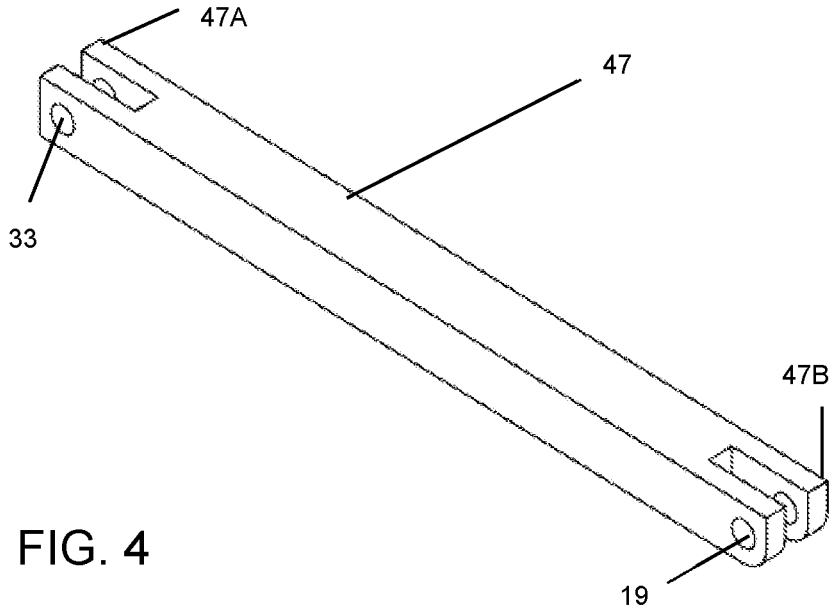
FIG. 4 shows an upper arm of a support member.
Figure 5:
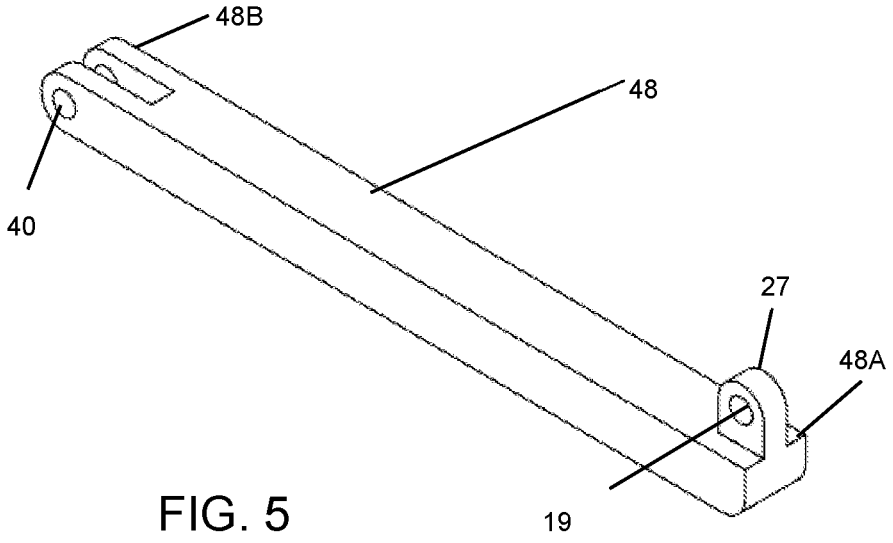
FIG. 5 shows a lower arm of a support member.

As seen in FIG. 4, upper arm 47 has an upper arm first end 47A and an upper arm second end 47B. As seen in FIG. 5, lower arm 48 has a lower arm first end 48A and a lower arm second end 48B. As shown in FIG. 1C, hinge 90 couples upper arm second end 47B to lower arm first end 48A. Preferably, each upper arm 47 is bonded to the left boundary 21L of one upper slat and to the right boundary 21R of another, adjacent, upper slat such that the upper arm second end 47B is located near the rim segment 11, or outer periphery, of the slats.

Referring again to FIGS. 4 and 5, in this embodiment, lower arm first end 48A includes a protrusion 27 received by the upper arm second end 47B. Lower arm first end 48A and upper arm second end 47B each have an aperture 19. Support hinges 90 have a pin that extends through aperture 19 to connect the lower arm first end 48A and the upper arm second end 47B.

iii. Attachment of Lower Arms and Slidable Member

As shown in FIG. 1B, for each support member 46, lower arm second end 48B is connected to slidable member 30 at slidable member hinges 80 such that longitudinal movement of the slidable member 30 causes corresponding movement of support members 46. Slidable member hinges 80 have a pin 14 that extend through aperture 40 in the lower arm second end 48B (see FIG. 5). However, any suitable connection may be used such as: a ball-and-joint hinge, ball bearing hinge, barrel hinge, butt hinge, concealed hinge, knife hinge, piano hinge, pivot hinge, or strap hinge. While hinges are preferred, any form of coupling may be used between the slidable member and the support members.

iv. Attachment of Upper Arms and Fixed Member

As shown in FIGS. 1B and 3, for each support member 46, upper arm first end 47A is connected to fixed member 10 at fixed member hinges 60. In the preferred embodiment, as shown in FIG. 2, fixed member 10 has eight sides and eight protrusions 72, corresponding to eight upper slats 20. Each upper arm first end 47A connects to one of the protrusions 72 via one of the fixed member hinges 60. In this embodiment, the fixed member hinges 60 have a pin 16 that passes through aperture 33 in upper arm first end 47A and protrusions 72 (see also FIG. 4). However, any other suitable connection may be used, such as: a ball-and-joint hinge, ball bearing hinge, barrel hinge, butt hinge, concealed hinge, knife hinge, piano hinge, pivot hinge, or strap hinge. While hinges are preferred, any form of coupling may be used between the fixed member and the support members. For example, the upper arm first end 47A may be welded to the fixed member hinges 60. Although in the preferred embodiment fixed member 10 has the same number of sides as upper slats, other configurations may be used. For example, the fixed member 10 could be any suitable shape with any number of sides, such as circle or a triangle. It is also envisioned that fixed member 10 is shaped so that it does not have the same number of sides as number of upper slats. Preferably, the fixed member 10 is made out of aluminum but any suitable material may be used.

D. Other Embodiments

FIG. 2 shows a second embodiment of a foldable table 100. In this embodiment, support members 46 are implemented as lower slats 76. Lower slats 76 are coupled to slidable member 30 via slidable member hinges 80 such that longitudinal movement of slidable member 30 causes corresponding movement of lower slats 76.

Lower slats 76 have a first lower slat end 76A and a second lower slat end 76B. The lower slats 76 are connected to the upper slats 20 at slat hinges 110. For each upper and lower slat pair, the lower slat end 76B is hinged to the first upper slat end 20.

As shown in FIG. 3, table 100 can also include a latch 36 for holding slidable member 30 in place when table 100 is deployed in the open position.

The illustrated embodiments discussed above are only preferred examples of the invention and should not be taken as limiting the scope of the invention. Rather, the scope of the invention is defined by the following claims.

I claim:

1. A foldable table comprising:

a shaft having a first end and a second end, the first end comprising an auger, the shaft defining a longitudinal axis;

a plurality of upper slats movable between an open position and a closed position, at least a portion of the slats forming a flat tabletop surface when in the open position;

a fixed member fixably coupled to the shaft proximal to the second end of the shaft, wherein the fixed member houses a handle;

the handle shaped to facilitate twisting of the shaft to drive the auger into a ground surface;

the fixed member further comprising a first number of protrusions;

a slidable member slidably coupled to the shaft for movement along the longitudinal axis between a first position and a second position, the upper slats being in the open position when the slidable member is in the first position, the upper slats being in the closed position when the slidable member is in the second position;

a second number of support members connected to the upper slats, each support member being coupled to the slidable member, wherein the first number of protrusions equals the second number of support members;

the support members comprising upper arms and lower arms, each upper arm having an upper arm first end and an upper arm second end, and each lower arm having a lower arm first end and a lower arm second end;

a plurality of support hinges, each support hinge holding one of the upper arm first ends and one of the lower arm second ends such that the upper arms can pivot with respect to the lower arms;

a plurality of fixed member hinges, each fixed member hinge connecting one of the upper arm second ends to one of the protrusions;

a metal rim disposed along an outer edge of the plurality of upper slats, wherein the metal rim is formed in segments, each segment being disposed on a periphery of an upper slat.

2. The foldable table according to claim 1, the slidable member comprising a disk.

3. The foldable table according to claim 1, the fixed member comprising a flat plate.

4. The foldable table according to claim 1, comprising a plurality of slidable member hinges, each slidable member hinge coupling one of the support members to the slidable member.

5. The foldable table according to claim 1, each lower arm first end being coupled to the slidable member.

6. The foldable table according to claim 5, each upper slat comprising a left half and a right half, the left half and right half of each upper slat being joined at and foldable about a central edge;

each upper arm being fixed to the left half of one upper slat and the right half of an adjacent upper slat.

7. The foldable table according to claim 1, wherein the handle is configured for movement along the longitudinal axis between an engaged position and a disengaged position;

wherein in the engaged position the handle extends longitudinally upward relative to the flat tabletop surface in the open configuration.

8. The foldable table according to claim 7, wherein the handle is T-shaped.

9. The foldable table according to claim 1, wherein the slidable member comprises a latch, the latch configured to prevent longitudinal movement of the slidable member.

10. The foldable table according to claim 1, each upper arm first end comprising a first aperture;

each lower arm second end comprising a second aperture;

the support hinges further comprising a plurality of pins, each pin extending through one of the first apertures and one of the second apertures.

11. The foldable table according to claim 1, wherein the plurality of protrusions consists of eight protrusions.

12. The foldable table according to claim 1, wherein the plurality of support members consists of eight support members.

13. A foldable table comprising:

a shaft having a first end and a second end, the first end comprising an auger, the shaft defining a longitudinal axis;

a plurality of upper slats movable between an open position and a closed position, at least a portion of the slats forming a flat tabletop surface when in the open position, each of the upper slats having a first upper slat end and a second upper slat end;

a plurality of lower slats movable between an open position and a closed position, each of the lower slats having a first lower slat end and a second lower slat end, and a fixed member fixably coupled to the shaft proximal to the second end of the shaft, wherein the fixed member houses a handle;

the handle shaped to facilitate twisting of the shaft to drive the auger into a ground surface;

the fixed member further comprising a first number of protrusions;

a slidable member slidably coupled to the shaft for movement along the longitudinal axis between a first position and a second position, the upper slats being in the open position when the slidable member is in the first position, the upper slats being in the closed position when the slidable member is in the second position;

a second number of slat hinges, each slat hinge connecting one of the first upper slat ends to one of the second lower slat ends, wherein the first number of protrusions equals the second number of slat hinges;

a plurality of fixed member hinges, each fixed member hinge connecting one of the second upper slat ends to one of the protrusions;

a metal rim disposed along an outer edge of the plurality of upper slats, wherein the metal rim is formed in segments, each segment being disposed on a periphery of an upper slat.

14. The foldable table according to claim 13, further comprising:

a plurality of slidable member hinges, each slidable member hinge connecting one of the first lower slat ends to the slidable member;

the upper slats and lower slats forming an angle less than 90 degrees when the slidable member is the first position.

* * * * *